US010640984B2

(12) United States Patent
Chen et al.

(10) Patent No.: US 10,640,984 B2
(45) Date of Patent: May 5, 2020

(54) HANDRAIL

(71) Applicant: Xiamen Lota International Co., Ltd, Xiamen (CN)

(72) Inventors: Lianyong Chen, Xiamen (CN); Shixiang Jiang, Xiamen (CN); Meiling Chen, Xiamen (CN); Chuanbao Zhu, Xiamen (CN)

( * ) Notice: Subject to any disclaimer, the term of this patent is extended or adjusted under 35 U.S.C. 154(b) by 0 days.

(21) Appl. No.: 16/215,839

(22) Filed: Dec. 11, 2018

(65) Prior Publication Data

US 2020/0040586 A1 Feb. 6, 2020

(30) Foreign Application Priority Data

Aug. 3, 2018 (CN) ..... 2018 2 1251575 U

(51) Int. Cl.

| | |
|---|---|
| ***E04F 11/18*** | (2006.01) |
| ***F21V 23/04*** | (2006.01) |
| ***F21V 15/01*** | (2006.01) |
| ***F21V 23/00*** | (2015.01) |
| ***F21V 23/02*** | (2006.01) |
| ***F21S 8/00*** | (2006.01) |
| *F21Y 115/10* | (2016.01) |

(52) U.S. Cl.

CPC ..... *E04F 11/1802* (2013.01); *F21S 8/033* (2013.01); *F21V 15/01* (2013.01); *F21V 23/001* (2013.01); *F21V 23/003* (2013.01); *F21V 23/02* (2013.01); *F21V 23/0471* (2013.01); *E04F 11/1804* (2013.01); *E04F 11/1808* (2013.01); *E04F 2011/1872* (2013.01); *F21Y 2115/10* (2016.08)

(58) Field of Classification Search

CPC ..... E04F 2011/1872; E04F 11/1802; F21V 31/005

See application file for complete search history.

(56) References Cited

U.S. PATENT DOCUMENTS

| | | | | |
|---|---|---|---|---|
| 7,901,115 | B2 * | 3/2011 | Chien | H04N 5/2354 362/397 |
| 2007/0098334 | A1 * | 5/2007 | Chen | F21V 29/004 385/92 |
| 2008/0278941 | A1 * | 11/2008 | Logan | F21V 5/00 362/234 |
| 2009/0052199 | A1 * | 2/2009 | Bolander, Jr. | B60Q 1/2607 362/509 |
| 2010/0157596 | A1 * | 6/2010 | Wen | F21V 31/005 362/235 |

(Continued)

*Primary Examiner* — Julie A Bannan

(74) *Attorney, Agent, or Firm* — The Law Office of Austin Bonderer, PC; Austin Bonderer

(57) ABSTRACT

Provided is a handrail with an LED. The handrail comprises a bar, a first connecting component, and a second connecting component. The first connecting component is provided at a first end of the bar and secures the bar to a wall. The second connecting component is provided at a second end of the bar and secures the bar to the wall. The bar is long and narrow and comprises an installation groove. The installation groove is configured for receiving a light emitting assembly, which is configured for emitting visible light when sensing stimulation. The light emitting assembly comprises a sensing unit and a light emitting unit. The light emitting unit is capable of emitting light when the sensing unit senses the stimulation.

11 Claims, 8 Drawing Sheets

(56) References Cited

U.S. PATENT DOCUMENTS

2010/0315023 A1* 12/2010 Pesson ..... E04F 11/1836
315/313
2013/0058074 A1* 3/2013 Somei ..... F21V 33/006
362/145

* cited by examiner

HANDRAIL

CROSS-REFERENCE TO RELATED APPLICATIONS

The present application claims the benefit of Chinese Patent Application No. 201821251575.0, filed on Aug. 3, 2018. The above is hereby incorporated by reference.

TECHNICAL FIELD

The subject matter herein generally relates to the field of bathroom devices, in particular to a handrail with an LED.

BACKGROUND

For the purpose of convenience cleaning, most bathroom floor installations are level and smooth. This is convenient for cleaning purpose, but the level and smooth floor could be slippery when there is water on it. A slippery floor is undoubtedly the main cause of accidents in the bathroom for users. In an attempt to lower the risk of injury in the bathroom and aid users with disabilities, an assortment of grab bathroom handrails has become widespread in bathroom facilities. Bathroom handrails are mounted on the walls of the bathroom or restroom to provide a source of support, which a person can utilize to get into standing or sitting position. Currently, a popular form of the handrail is the conventional straight grab bar, which is a stationary fixed rail bolted or otherwise attached to a wall that allows a user to grab with his or her hands in order to aid in the transition between a seated and standing position. When lights in the bathroom are off, the user can barely hit the handrail on the wall. In this case, accidents might occur as users could not grope and grab the handrail to keep his or her body balance. This could be even more dangerous when the floor is wet.

SUMMARY

In order to address the technical problem above, the present disclosure provides a handrail with an LED. The handrail may emit visible light so that the bathroom users can accurately grab it without searching. Thus accident possibility in the bathroom/restroom could be further reduced.

To this end, the present disclosure provides a handrail with an LED. The handrail comprises a bar, a first connecting component, and a second connecting component. The first connecting component is provided at a first end of the bar and secures the bar to a wall. The second connecting component is provided at a second end of the bar and secures the bar to the wall. The bar is long and narrow and comprises an installation groove. The installation groove is configured for receiving a light emitting assembly, which is configured for emitting visible light when sensing stimulation. The light emitting assembly comprises a sensing unit and a light emitting unit. The light emitting unit is capable of emitting light when the sensing unit senses the stimulation.

In some embodiments, the first connecting component comprises a sensing hole on a first side back to the wall. The sensing hole is in communication with the installation groove, so as to allow the light emitting assembly to sense the stimulation through the sensing hole.

In some embodiments, the installation groove is arranged on a second side of the bar facing to the wall.

In some embodiments, the light emitting assembly comprises a body case, the light emitting unit, the sensing unit, and a sealing plate. The body case comprises a cavity and an opening mouth. The cavity of the body case is configured for placing the light emitting unit. A closure side of the body case, opposite to the opening mouth, is provided with a transmissive component. The transmissive component which covers the opening mouth of body case allows the visible light emitted by the light emitting unit to pass through. A wire slot is provided on a first side of the cavity adjacent to the first connecting component so that the sensing unit can be wired to the light emitting unit inside the cavity.

In some embodiments, the light emitting unit comprises an LED unit; a power supply for supplying power to the LED unit; and a control circuit board respectively connected the LED unit and the power supply.

In some embodiments, the sensing unit is connected to the control circuit board. The control circuit board is capable of driving the LED unit to emit visible light when the sensing unit sense stimulation.

In some embodiments, the sealing plate comprises a pad and a pressure plate. The pad is arranged between the pressure plate and the opening mouth of the body case and configured for covering the opening mouth completely, when the pressure plate is firmly attached to the body case.

In some embodiments, the pressure plate comprises a through hole. A first pad surface of the pad, facing to the pressure plate, comprises a protrusion corresponding to the through hole of the pressure plate.

In some embodiments, the closure side of the body case comprises a first surface. The first surface extends along a length direction of the bar and forms an ear at each side of the bar in the length direction. The ear comprises a first installation hole. A first threaded seat is arranged on the bottom of the installation groove along an axial direction of the first installation hole. A first connecting screw is arranged in the axial direction of the first installation and the first threaded seat so that the ear can be attached to the bar by the first connecting screw.

In some embodiments, a stopper is arranged on the first connecting screw. The stopper comprises an inner thread to fit with the first connecting screw and is disposed between the first installation hole and the first screw seat.

In some embodiments, a second surface, facing to the installation groove, of the ear comprises a second threaded seat. The pressure plate comprises a second installation hole. The second installation hole and the second threaded seat are connected by the second connecting screw.

In some embodiments, the LED unit is disposed adjacent to the transmissive component.

The handrail in the present disclosure can emit visible light by the LED unit. With the aid of the visible light, bathroom users can readily figure out the accurate position of the handrail. Even in the dark, e.g., lights off in the bathroom due to power failure, the handrail can emit light by its independent power supply. By this way, bathroom accident possibility could be reduced.

DETAILED DESCRIPTION OF THE INVENTION

In order to clarify the objectives, solutions, and advantages of the embodiments of the present disclosure, the technical solution of the embodiments will be described clearly and completely accompanied by the figures.

Figure 1:
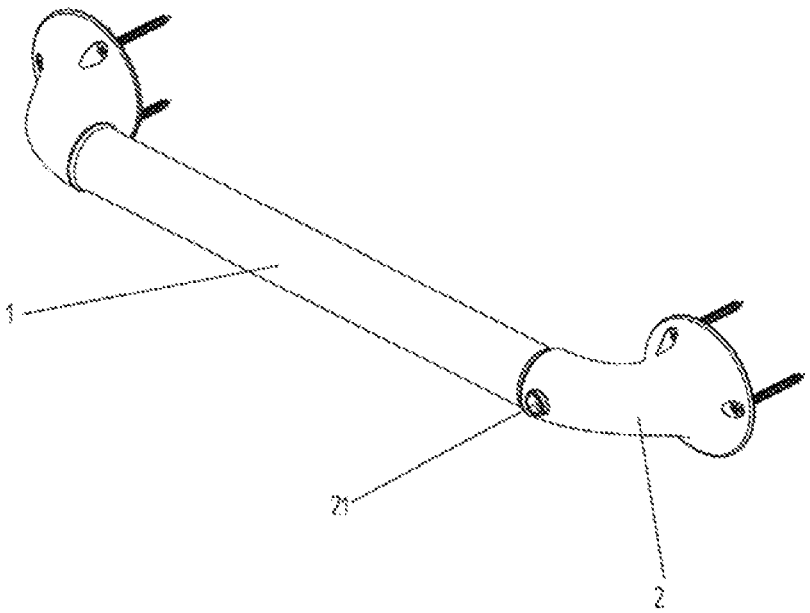
FIG. 1 is a schematic diagram of a handrail according to one embodiment of the present disclosure.
Figure 2:
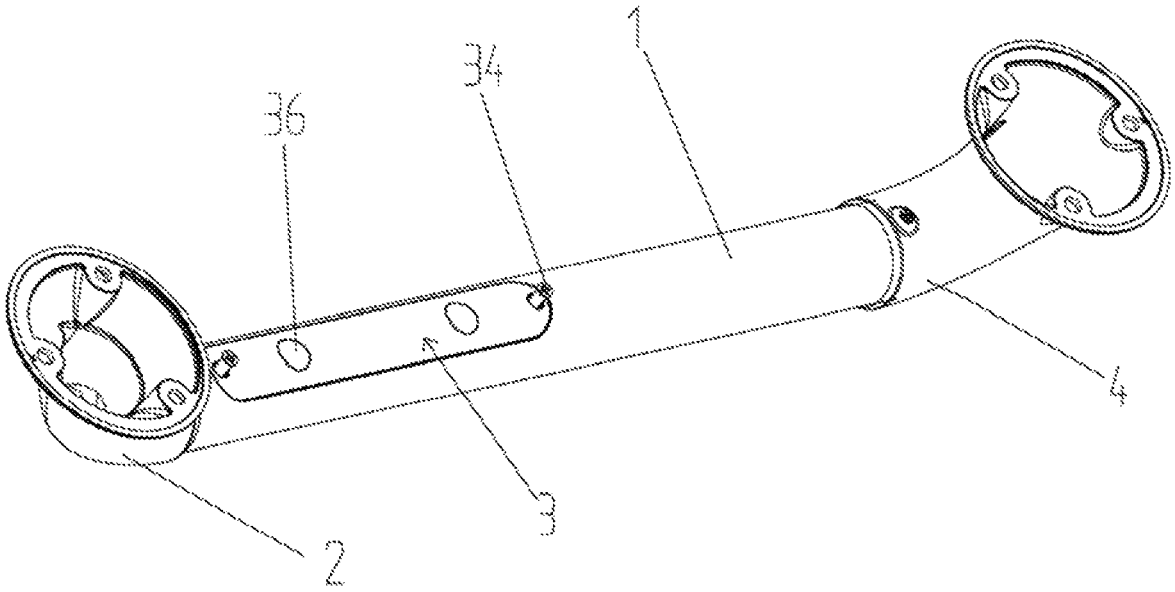
FIG. 2 is a schematic diagram of the handrail with a light emitting assembly according to one embodiment of the present disclosure.
Figure 3:
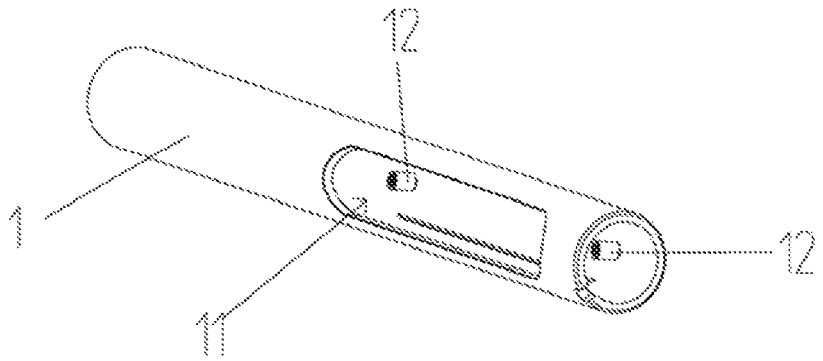
FIG. 3 is a schematic diagram of a bar of the handrail according to one embodiment of the present disclosure.
Figure 6A:
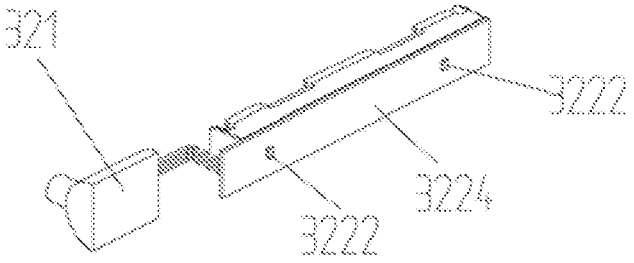
FIG. 6*a* is a schematic diagram of a sensing unit and a light emitting unit of the light emitting assembly according to one embodiment of the present disclosure.
Figure 6B:
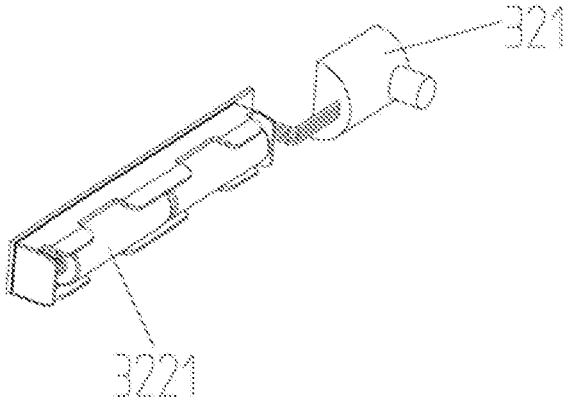
FIG. 6*b* is a schematic diagram of the sensing unit and the light emitting unit of the light emitting assembly in another view according to one embodiment of the present disclosure.
Figure 7:
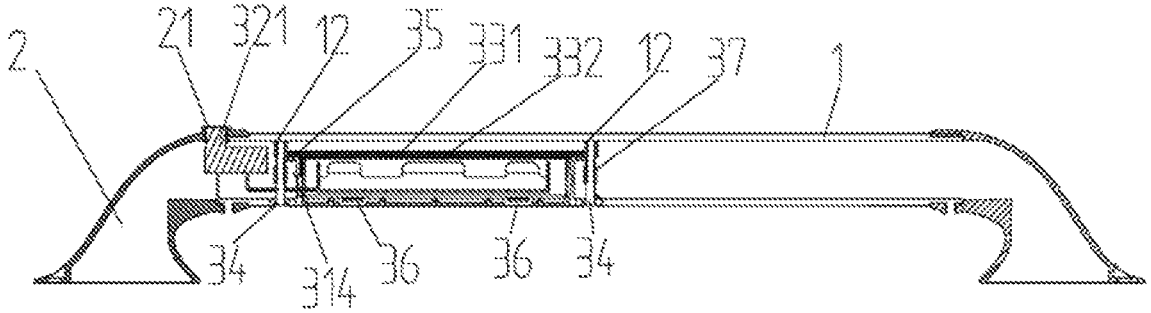
FIG. 7 is a schematic diagram showing an inner side of the handrail assembled with the light emitting assembly according to one embodiment of the present disclosure.

As shown in FIGS. 1-2, and 6*a*-6*b*, the present disclosure provides a handrail with an LED. The handrail comprises a bar 1, a first connecting component 2, and a second connecting component 4. The first connecting component 2 is provided at a first end of the bar 1, and secures the bar 1 to a wall. The second connecting component 4 is provided at a second end of the bar 1 and secures the bar 1 to the wall. As shown in FIG. 3, the bar 1 is long and narrow and comprises an installation groove 11. The installation groove 11 is configured for receiving a light emitting assembly 3, which is configured for emitting visible light when sensing stimulation. The light emitting assembly 3 comprises a sensing unit 321 and a light emitting unit 322. The light emitting unit 322 is capable of emitting light when the sensing unit 321 senses the stimulation. In some embodiments, the sensing unit 321 senses the stimulation and generates an electric signal. The generated electric signal will be transmitted to the light emitting unit 322, and therefore impels the light emitting unit 322 to emit light. In some embodiments, the sensing unit 321 may be an infrared sensor, a light sensor, or an acoustic sensor. Additionally, as shown in FIGS. 1 and 7, the sensing unit 321 may be arranged at a joint between the first connecting component 2 and the bar 1. A sensing hole is arranged at the joint, so that the sensing unit 321 may sense the stimulation through the hole. For example, when the sensing unit 321 is an infrared sensor, the sensing hole allows the infrared ray of the infrared sensor to be sent out from the empty cavity 311 of the bar 1. As shown in FIGS. 2 and 7, the installation groove 11 may be arranged on a second side of the bar 1 facing to the wall, so that the light emitting assembly 3 may face to the wall. Facing the wall may reduce the possibility of getting wet when in the bathroom.

Referring to FIG. 3, which is a schematic diagram of the bar 1. As can be seen, the bar 1 is hollow and narrow which two ends being in communication. The installation groove 11 may be an opening arranged along an axial direction of the bar 1. A first threaded seat 12 is arranged in the inner wall of the bar 1 and at the bottom of the installation groove 11. As shown in FIG. 7, the first threaded seat 12 is configured to fit with the first connecting screw 34 of the light emitting assembly 3, so as to anchor the light emitting assembly 3 to the bar 1.

Figure 4A:
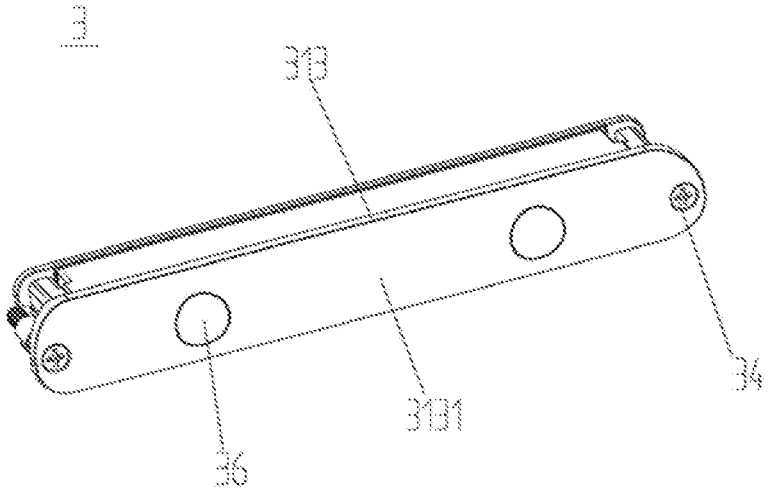
FIG. 4*a* is a schematic diagram of the light emitting assembly of the handrail according to one embodiment of the present disclosure.
Figure 4B:
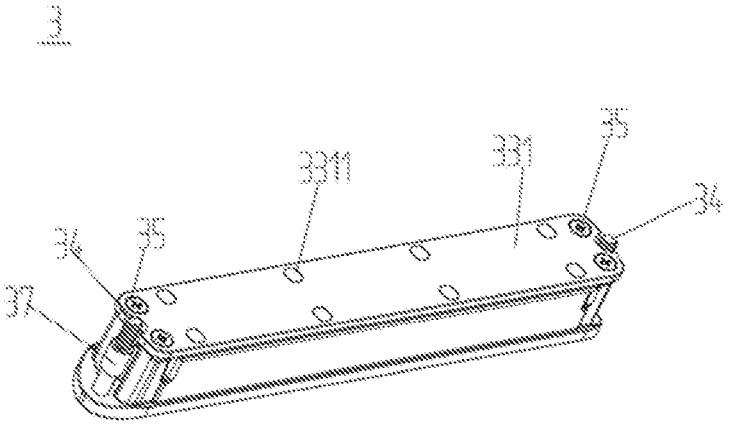
FIG. 4*b* is a schematic diagram of the light emitting assembly of the handrail in another view according to one embodiment of the present disclosure.
Figure 5:
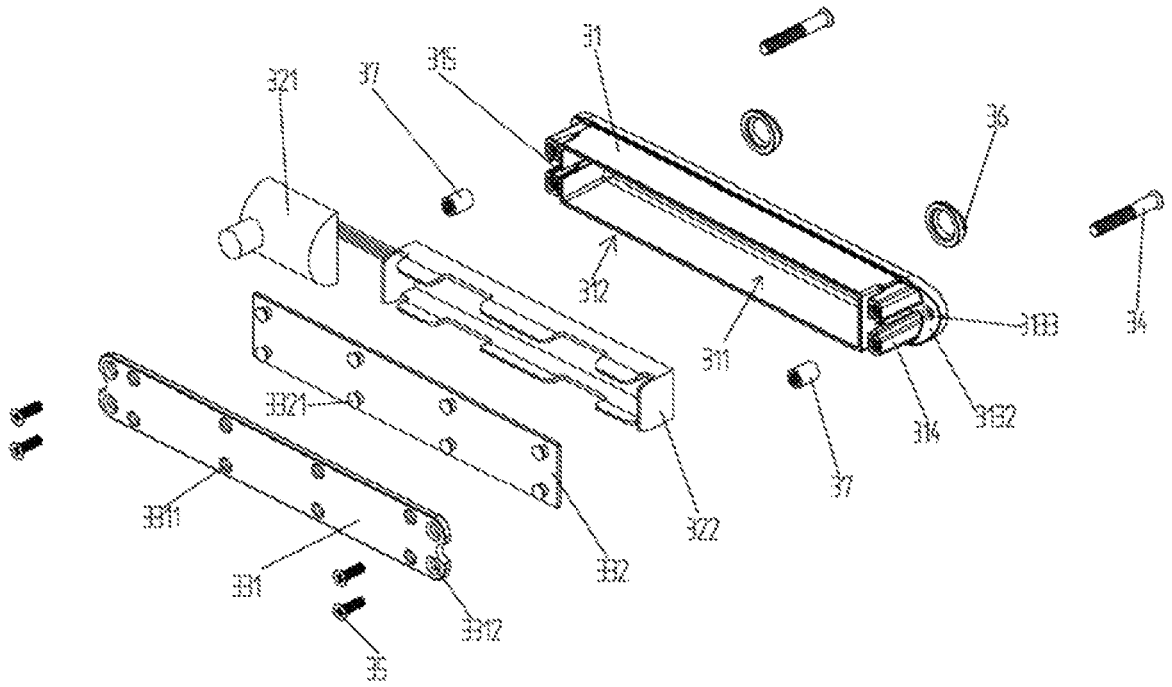
FIG. 5 is an exploded view of the light emitting assembly of the handrail according to one embodiment of the present disclosure.
Figure 6C:
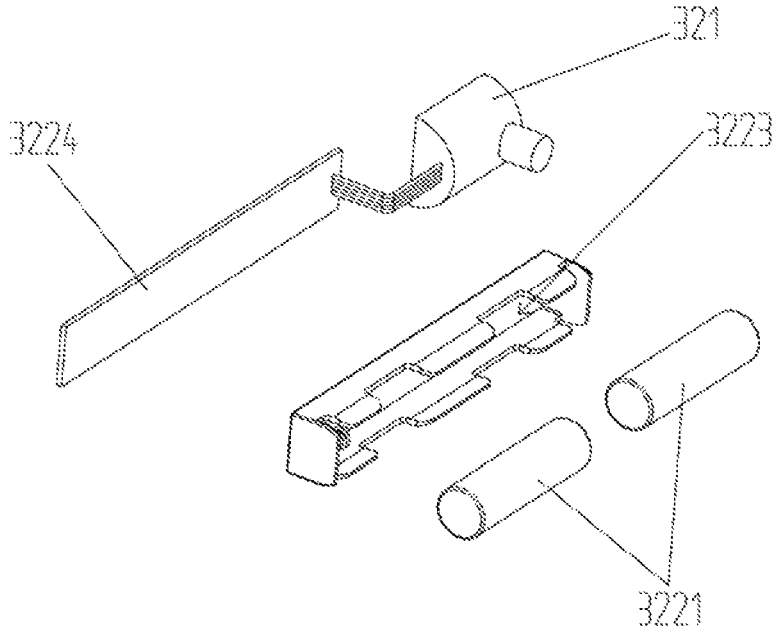
FIG. 6*c* is an exploded view of the sensing unit and the light emitting unit of the light emitting assembly according to one embodiment of the present disclosure.

FIGS. 4*a*, 4*b*, and 5 are schematic diagrams of the light emitting assembly 3. As shown in FIG. 5, the light emitting assembly 3 may comprise a body case 31, the light emitting unit 322, the sensing unit 321, and a sealing plate. The body case 31 comprises a cavity 311 and an opening mouth 312. The cavity 311 of the body case 31 is configured for placing the light emitting unit 322. A closure side 313 of the body case 31, opposite to the opening mouth 312, is provided with a transmissive component 36. The transmissive component 36, which covers the opening mouth 312 of the body case 31, allows the visible light emitted by the light emitting unit 322 to pass through. A wire slot 315 is provided on a first side of the cavity 311 adjacent to the first connecting component 2, so that the sensing unit 321 can be wired to the light emitting unit 322 inside the cavity 311. In some embodiments, as shown in FIGS. 6*a*-6*c*, the light emitting unit 322 comprises a LED unit 3222, a power supply 3221 for supplying power to the LED unit 3222; and a control circuit board 3224 respectively connected the LED unit 3222 and the power supply 3221. Referring to FIGS. 4*a*, 4*b*, and 5, the sensing unit 321 is connected to the control circuit board 3224. Via the control circuit board 3224, the sensing unit 321 can impel the LED unit 3222 to emit visible light when the sensing unit 321 senses the stimulation. As shown in these figures, the LED unit 3222 may be arranged in an axial direction of the transmissive component 36, so that the light emitted by the LED unit 3222 may pass through the transmissive component 36 to arrive outside of the bar 1. In some embodiments, the LED unit 3222 is disposed adjacent to the transmissive component 36.

Referring to FIG. 5, the sealing plate comprises a pad 332 and a pressure plate 331. The pad 332 is arranged between the pressure plate 331 and the opening mouth 312 of the body case 31. The pad 332 is configured for covering the opening mouth 312 completely when the pressure plate 331 is firmly attached to the body case 31. In order to make the pressure plate 331 secured to the pad 332 more tightly, the pressure plate 331 is provided with a plurality of through holes 3311. A first pad 332 surface of the pad 332, facing to the pressure plate 331, comprises a plurality of protrusions 3321 corresponding to the through holes 3322 of the pressure plate 331. The through holes 3311 are fitted with the protrusions 3321, avoiding a relative sliding between the pad 332 and the pressure plate 331. In some embodiments, the pad 332 is made of elastic material. By this manner, the pad 332 may have certain deformation under pressure from the pressure plate 331. The deformation of the pad 332 increases the sealing effectiveness of the opening mouth 312. In some embodiments, the pad 332 may comprise a head and a shaft with the head on one end. The head has a diameter greater than the shaft. Correspondingly, the through hole 3311 may comprise a first hole section and a second hole section. The first hole section is adjacent to the pad 332, while the second hole section is adjacent to the pressure plate 331. The second hole section has a diameter greater than the first hole section, so that the head of the protrusion 3321 may be clamped to a step arranged between the first hole section and the second hole section when the protrusion 3321 is inserted into the through hole 3311.

As shown in FIGS. 4*a*, and 5, the closure side 313 of the body case 31 comprises a first surface 3131. The first surface 3131 extends along a length direction of the bar 1 and forms an ear 3132 at each side of the bar 1 in the length direction. The ear 3132 comprises a first installation hole 3133. A first threaded seat 12 is arranged on the bottom of the installation groove 11 along an axial direction of the first installation hole 3133. A first connecting screw 34 is arranged in the axial direction of the first installation hole 3133 and the first threaded seat 12, so that the ear 3132 can be attached to the bar 1 by the first connecting screw 34.

As shown in FIGS. 4*a*, 4*b*, and 5, a stopper 37 is arranged on the first connecting screw 34. The stopper 37 comprises an inner thread (not shown) to fit with the first connecting screw 34, and is disposed between the first installation hole 3133 and the first threaded seat 12. In some embodiments, the stopper 37 is free in the installation groove 11. When the stopper 37 is fitted with the first connecting screw 34 by a thread, the stopper 37 may be rotated with the first connecting screw 34. As shown in these figures, the stopper 37 has an outer diameter greater than the first installation hole 3133. When in use, the first connecting screw 34 is fitted with the first threaded seat 12 through the stopper 37. When users intend to detach the light emitting assembly 3 from the installation groove 11, they rotate the first connecting screw 34 first so as to detach the first connecting screw 34 from the first threaded seat 12. After the first connecting screw 34 is detached from the first threaded seat 12, the first connecting screw 34 will not detach from the first installation hole 3133 due to the existence of the stopper 37. In some embodiments, with the aid of the stopper 37, the first connecting screw 34 will not be rotated to detach from the first installation hole 3133 after the first connecting screw 34 is detached from the first threaded seat 12 because the stopper 37 will be rotated with the first connecting screw 34. In other words, in some embodiments, the first connecting screw 34 will be withdrawn only halfway of the first installation hole 3133, instead of complete withdrawn. By this design, the halfway-withdrawn screw may be considered as a handle to pull the whole light emitting assembly 3 out from the installation groove 11.

In some embodiments, the first surface 3131 of the closure side 313 is matched with a circumferential surface of the bar 1, so that a joint between the first surface 3131 and the circumferential surface is smooth. In this case, the first connecting screw 34 which is half-withdrawn could be a force application point for pulling out the light emitting assembly 3.

As shown in FIGS. 4*b*, and 5, a second surface, facing to the installation groove 11, of the ear 3132 comprises a second threaded seat 314. The pressure plate 331 comprises a second installation hole 3312. The second installation hole 3312 and the second threaded seat 314 are connected by the second connecting screw 35.

The above are merely embodiments of the present disclosure and are not intended to limit the present disclosure. Any modifications, equivalent replacements, and improvements made within the spirit and principle of the present disclosure may be made by one of ordinary skill in the art and shall be comprised in the protection of the present disclosure.

What is claimed is:

1. A handrail, comprising:

a bar comprising an installation groove;

a first connecting component located at a first end of the bar and configured to secure the bar to a wall; and a second connecting component located at a second end of the bar and configured to secure the bar to the wall; and a light emitting assembly, located within the installation groove, comprising a sensing unit and a light emitting unit;

wherein the light emitting unit is capable of emitting light when a sensing unit senses a stimulation;

the light emitting assembly comprises a body case comprising: a cavity and an opening mouth; the light emitting unit, the sensing unit, and a sealing plate; wherein the light emitting unit is located within the cavity, and the opening mouth is sealed by the sealing plate;

the sealing plate comprises a pad and a pressure plate; the pad is arranged between the pressure plate and the opening mouth of the body case; and the opening mouth is covered by the pad completely when the pressure plate is firmly attached to the body case.

2. The handrail of claim 1, wherein the first connecting component comprises a sensing hole extending from the installation groove to a first side of the bar.

3. The handrail of claim 1, wherein the installation groove is arranged on a second side of the bar, which is configured to face the wall.

4. The handrail of claim 1, wherein a transmissive component is arranged on a closure side of the body case; and the closure side is opposite to the opening mouth.

5. The handrail of claim 4, wherein the cavity comprises a first side adjacent to the first connecting component; a wire slot is provided on the first side, so that the sensing unit is wired to the light emitting inside the cavity.

6. The handrail of claim 1, wherein the light emitting unit comprises an LED unit; a power supply for supplying power to the LED unit; and a control circuit board respectively connected the LED unit and the power supply.

7. The handrail of claim 6, wherein the sensing unit is connected to the control circuit board; and the control circuit board is capable of driving the LED unit to emit visible light when the sensing unit sense stimulation.

8. The handrail of claim 1, wherein the pressure plate comprises a through hole;

a first pad surface of the pad, facing the pressure plate, comprises a protrusion corresponding to the through hole of the pressure plate.

9. The handrail of claim 1, wherein the closure side of the body case comprises a first surface; the first surface extends along a length direction of the bar and forms an ear at each side of the bar in the length direction;

the ear comprises a first installation hole;

a first threaded seat is arranged on the bottom of the installation groove along an axial direction of the first installation hole; and a first connecting screw is arranged in the axial direction of the first installation hole and the first threaded seat, so that the ear is attached to the bar by the first connecting screw.

10. The handrail of claim 9, wherein a stopper is arranged on the first connecting screw; the stopper comprises an inner thread to fit with the first connecting screw, and is disposed between the first installation hole and the first threaded seat.

11. The handrail of claim 9, wherein a second surface, facing the installation groove, of the ear comprises a second threaded seat;

the pressure plate comprises a second installation hole; and the second installation hole and the second threaded seat are connected by a second connecting screw.

* * * * *